United States Patent [19]

Bean

[11] Patent Number: 4,723,776

[45] Date of Patent: Feb. 9, 1988

[54] COMPOSITION DISK ROTATING GAME DEVICE

[76] Inventor: Jeffrey W. Bean, 27 Minerva Ave., Sanford, Me. 04073

[21] Appl. No.: 886,003

[22] Filed: Jul. 16, 1986

[51] Int. Cl.[4] ..... A63F 9/00

[52] U.S. Cl. ..... 273/1 G; 273/155

[58] Field of Search ..... 273/1 G, 155, 241, 271

[56] References Cited

U.S. PATENT DOCUMENTS 4,560,164 12/1985 Darling ..... 273/155

4,632,399 12/1986 Bern ..... 273/155

*Primary Examiner*—Anton O. Oechsle

[57] ABSTRACT

A competitive disk rotating game device designed to employ several different forms of play into one fast paced two player unit and consist of a series of multi-colored and uniquely patterned disks which are rotated to the left and right by the interactive pushing, pulling, and rotation of each player's handle, one at each end of the rotating disks.

1 Claim, 11 Drawing Figures

COMPOSITION DISK ROTATING GAME DEVICE

BACKGROUND OF THE INVENTION

There are many different forms of game play available today from racquet ball to the Rubik's Cube, each requiring either luck, skill, strategy, dexterity, concentration, or any combination there of.

It is the object of this invention to provide a unique form of game play in which two individuals interactively compete in both the mental and physical arena.

SUMMARY OF THE INVENTION

The present invention utilizes a series of disks which rotate about a central axis. Each disk is covered by several different colors equally spaced about the circumference, yet each disk has its own unique pattern. The disks are controlled by two handles, one at each end of the row of disks. Each player has the opportunity to control any one or two of the disks at any moment, except that which is being controlled by the opponent. The specific disk(s) a player wishes to control is done so by pushing or pulling the handle until the desired disk(s) is reached. The disk(s) is then rotated to the left or right by rotating the handle. Once the disk(s) is rotated, the player may push or pull the handle to a different position in order to make another move. It should be noted however that the next move can only be made in the opposite direction.

The object of the game is to align your pre-chosen color(s) before your opponent does so. During the play, the actions of one player affects that of the other. This required a constant change of strategy on the part of both players. This also provides for a very physical challenge.

DETAILED DESCRIPTION OF THE VIEWS

Figure 1:
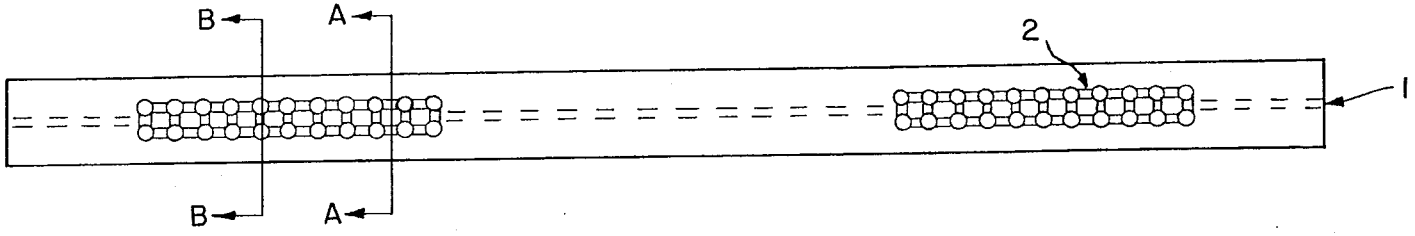
FIG. 1 is a side view of the center shaft.
Figure 6:
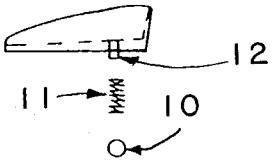
FIG. 6 is an exploded view of the ball guide assembly.

FIG. 1 is a view of the center shaft of the present invention. It is to be made in an injection mold as one piece. The shaft is to have a groove 1 which extends from end to end. This groove is used to align the stationary disks of FIG. 9. On the opposite side of the groove, there are to be two sets of tracks 2 which are to be used as guides for the positioning of the handles of FIG. 4. The ball guide assembly of FIG. 6 is to set into these tracks and restrict the movement of the handles to their precise positions. (This track system is not crucial to the design. Tracks of different shapes and functions may be used and the tracks may even be eliminated.)

Figure 2:
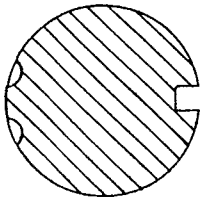
FIG. 2 is a cross sectional view of FIG. 1 at A—A.

FIG. 2 is a cross sectional view of FIG. 1 at A—A. The two tracks are to be cut with a ball cutter at a depth of one quarter of its radius.

Figure 3:
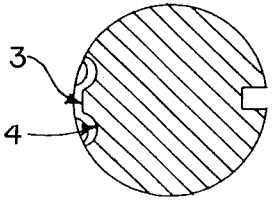
FIG. 3 is a cross sectional view of FIG. 1 at B—B.

FIG. 3 is a cross sectional view of FIG. 1 at B—B. This view shows the connecting tracks 3 which connect the tracks shown in FIG. 2 together. At each position where the handle is to stop, the ball guide of FIG. 6 is to sit down into an indentation 4. These indentations are to be cut with the same cutter as the tracks, yet are to be drilled less than one-half of its own radius.

Figure 4:
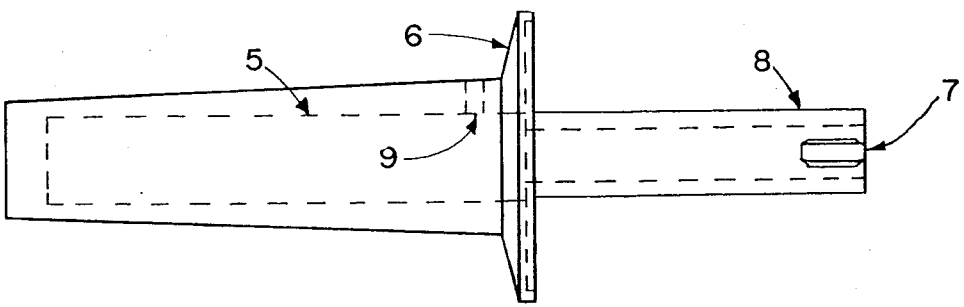
FIG. 4 is a side view of a typical handle.

FIG. 4 is a side view of a typical handle. This is to be made as one piece in an injection mold. The handle is to have a hollow center 5 which is to slide freely over the shaft of FIG. 1. Hole 9 is to align with the tracks and indentations of the center shaft. This is what the ball guide assembly of FIG. 6 sets. The handle guard 6 is to present the players fingers from being caught between the guard and the disks. Tab 7 is what transfers the rotation of the handles to the multi-colored disks of FIG. 7. This tab is to fit into the teeth of the rotatable disks of FIG. 7 while the shaft 8 is to rotate free from interference with the rotating or stationary disks.

Figure 5:
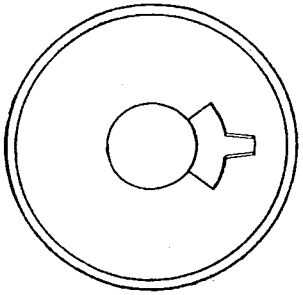
FIG. 5 is an end view of FIG. 4.

FIG. 5 is an end view of FIG. 4.

FIG. 6 is an exploded view of the ball guide assembly. This assembly sets into hole 9 of FIG. 4. Ball 10 sits into the tracks of FIG. 1. Spring 11 is to keep the ball in the track yet allows it to pop in and out of the indentations. Stop 12 is to prevent the ball from backing out of the track.

Figure 7:
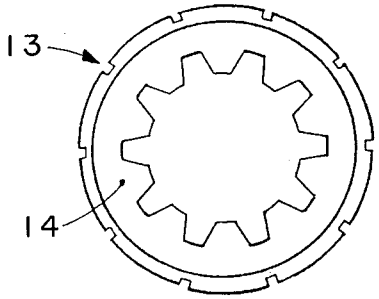
FIG. 7 is a side view of a typical rotating disk.

FIG. 7 is a side view of a typical rotating disk. These disks are to be made as one piece in an injection mold. Several different colors cover the outside of the disks and are divided equally about the surface by grooves 13 cut slightly into the surface. The inner portion 14 of the disks are recessed as to allow the stationary disks of FIG. 9 to fit. This recess is to be slightly less than half of the thickness of the stationary disks as to allow a slight gap between each rotating disk.

Figure 8:
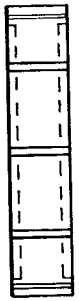
FIG. 8 is an end view of FIG. 7.

FIG. 8 is an end view of FIG. 7.

Figure 9:
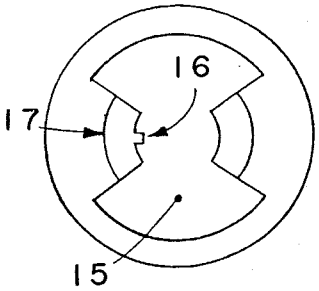
FIG. 9 is a side view of a typical stationary disk.

FIG. 9 is an end view of a typical stationary disk. These stationary disks are what the rotating disks of FIG. 7 rotate about. Inside opening 15 is so that tab 7 and shaft 8 of FIG. 4 can pass freely. Tab 16 is used to align the disks on the center shaft and fits into groove 1 of FIG. 1. These disks are kept the proper distance apart by the spacer 17. This spacer portion of the disk is of a diameter which allows the teeth of FIG. 7 to rotate about without causing interference.

Figure 10:
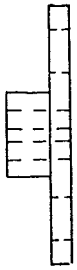
FIG. 10 is an end view of FIG. 9.

FIG. 10 is an end view of FIG. 9.

Figure 11:
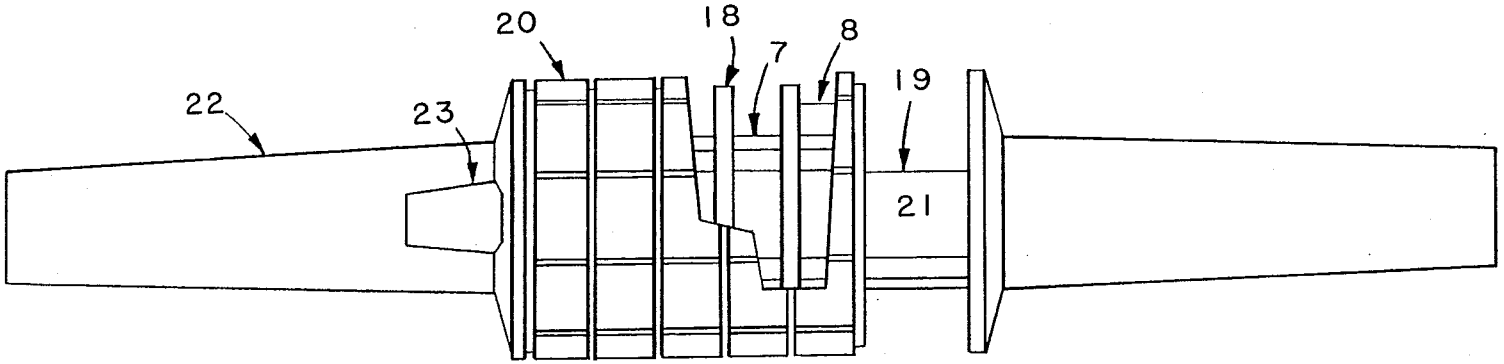
FIG. 11 is a view of the complete assembly of all the components.

FIG. 11 is a view of the present invention in its assembled form with a cut-away portion to help in its illustration. The stationary disks 18 are to be slid over the main shaft 19 with a rotating disk 20 in between each. The stationary disks are kept in their proper position by the spacer 24 and are to be glued to both the shaft 19 and its neighboring disk. The handles 22 are then slid into the shaft and kept in its proper position by the ball guide assembly 23 which is then put in place and glued. The shaft 8 of handle 22 is then free to travel within the mechanism while tab 7 fits into the teeth of the rotating disk 20.

I claim:

1. A two player game combining an assembly of components in modifiable form by the rotation and sliding of two handles, said handles being separated by a series of equally spaced rotating disks, each disk being covered with a unique pattern of colors spaced equally about its circumference, means for rotating selected ones of said disks by the pushing, pulling and rotation of said handles about a central common axis, each rotating disk being free to rotate fully about its axis and held secure by additional stationary disks rigidly connected to a center shaft between each rotating disk.

* * * * *